US006886502B1

(12) United States Patent
Srinivasan

(10) Patent No.: US 6,886,502 B1
(45) Date of Patent: May 3, 2005

(54) METHOD FOR CONTROLLING STEAM GENERATORS

(75) Inventor: Jagannathan Seenu Srinivasan, Murrysville, PA (US)

(73) Assignee: Westinghouse Electric Company LLC, Pittsburgh, PA (US)

( * ) Notice: Subject to any disclaimer, the term of this patent is extended or adjusted under 35 U.S.C. 154(b) by 25 days.

(21) Appl. No.: 10/874,666

(22) Filed: Jun. 23, 2004

(51) Int. Cl.[7] ..... F22D 5/30
(52) U.S. Cl. ..... 122/451.1; 122/459; 122/451 R
(58) Field of Search ..... 122/451.1, 451.2, 122/451 R, 456, 448.1, 459, 412, 414, 420, 122/422; 376/210, 211, 214

(56) References Cited

U.S. PATENT DOCUMENTS 4,290,850 A 9/1981 Omori et al.
4,526,136 A * 7/1985 Boland et al. ..... 122/451.1
4,635,589 A * 1/1987 Draper et al. ..... 122/356
4,707,324 A 11/1987 Storrick
4,728,481 A 3/1988 Geets
4,777,009 A 10/1988 Singh et al.
4,912,732 A 3/1990 Singh
5,148,775 A * 9/1992 Peet ..... 122/451 R
5,192,493 A 3/1993 Erin et al.
5,455,763 A 10/1995 Feingold
5,559,293 A * 9/1996 Kirkpatrick ..... 73/861
6,021,169 A 2/2000 Robertson et al.
6,055,945 A 5/2000 Simoni

* cited by examiner

*Primary Examiner*—Gregory A. Wilson

(57) ABSTRACT

A method of controlling the feedwater flow to the secondary side of a steam generator in a pressurized water nuclear reactor monitors various process variables such as the feedwater and the steam flows and pressures around the secondary side of the steam generator and then generates process signals based upon the process variables. An error signal based upon selected process signals is generated. The error signal is filtered by a deadband filter network for generating a control signal with a deadband. The control signal with a deadband is sent to a proportional-integral controller for generating a demand signal. The demand signal is then sent to an operator such as feedwater valve positioner or a feedwater pump speed controller for controlling the feedwater flow into the steam generator.

10 Claims, 5 Drawing Sheets

METHOD FOR CONTROLLING STEAM GENERATORS

BACKGROUND OF THE INVENTION

The invention relates to a method for controlling steam generators of pressurized water nuclear reactors (PWRs) and more particularly to method for controlling the flow of feedwater to the secondary sides of PWR steam generators.

In commercial PWRs utilized to generate electrical power, reactor coolant water (or primary water) recirculates between a reactor pressure vessel and one of a plurality of in-parallel steam generators in a closed loop known as a reactor coolant system (or a primary system). In a steam generator, the heat in the recirculating primary water flowing through the primary side (i.e., the tube side) passes through the walls of the tubes and is absorbed by relatively cool secondary water flowing on the secondary side (or shell side). The transferred heat generates steam on the secondary side at a temperature of about 500° F. or more and at a pressure of about 800 psi or more. The steam flows out of the steam generators to turbines that generate the electrical power. The exhaust steam from the turbines is condensed and recirculated to the steam generators as feedwater. The nominal flow of feedwater to a steam generator of commercial PWRs may be 100,000 gpm or more during normal power generation operations.

U.S. Pat. Nos. 6,021,169; 5,455,763; 5,192,493; 4,777,009 and 4,728,481, which are incorporated by this reference, disclose various control systems for controlling steam generators during power operations. Such control systems generally have two mode proportional-integral controllers with feedback for providing demand signals to positioners operating flow control valves and/or speed controllers controlling the main feedwater pumps. Proportional (gain) mode generally shapes the response curves, with higher gains generally giving faster transients but more oscillatory responses. Integral (reset) mode eliminates steady state offsets. Proportional-integral controllers may also have a derivative (rate) element that allows higher proportional gains for high ordered systems.

These PWR steam generator control systems (i.e., systems using proportional-integral control, especially with a derivative element) have a tendency of continuously "hunt" to minimize steady state errors, which is a principal objective of control engineers. Advantageously, proportional-integral control systems can be readily analyzed. Undesirably, this "hunting" tendency causes accelerated wear of various control hardware such as valve stems, positioners and actuators.

Filtering networks known as "deadbands" have long been employed to reduce "hunting" and consequent hardware wear by control engineers in applications where discrete variables are monitored. Thus, deadbands have been employed to control the movement of control rods in reactor pressure vessels which move in discrete steps. See, e.g., U.S. Pat. No. 4,707,324. However, because of the analytical complexity of analyzing control systems employing proportional-integral systems with deadbands in addition to the complication of designing the necessary hardware, the nuclear industry has been unwilling to employ deadbands with the proportional-integral (with or without a derivative element) controllers employed to continuously control steam generators.

SUMMARY OF THE INVENTION

It is an object of the present invention to provide a responsive method for effectively controlling feedwater flow to PWR steam generators with less wear of the control system hardware. It is a further object to control feedwater flow to PWR steam generators using deadband filters in combination with proportional-integral controllers.

With these objects in view, the present invention resides in a method of controlling the feedwater flow to the secondary side of a steam generator in a pressurized water nuclear reactor. In accordance with this method, process variables around the secondary side of the steam generator are monitored and process signals based upon the monitored process variables are generated. The monitored process variables may be feedwater and steam flows, feedwater and steam pressures, water level in the steam generator and the like. An error signal based upon at least one of the monitored process signals is generated and the error signal is filtered to generate a control signal with a deadband. The control signal with a deadband is sent to a proportional-integral controller to generate a demand signal, which in turn is sent to an operator for controlling the feedwater flow. The operator may be a valve positioner or a speed controller controlling a feedwater pump. In a preferred practice, the deadband is field adjustable.

In a preferred practice of the present invention, the water level on the secondary side of the steam generator, the feedwater flow into the secondary side of the steam generator and the steam flow from the secondary side of the steam generator are monitored. A water level signal based upon the monitored water level, a feedwater flow signal based upon the monitored feedwater flow and a steam flow signal based upon the monitored steam flow are generated. An error signal based upon the water level signal is generated. The error signal is filtered to generate a control signal that changes only when the deadband is exceeded. The control signal is sent to a proportional-integral controller for generating a demand signal. The demand signal is then sent to a feedwater valve positioner for controlling the feedwater flow to the steam generator. Advantageously, control systems utilizing the present invention have proven to least as stable and as effective as control systems previously employed by the nuclear industry.

Preferably, the magnitudes of the deadbands are limited (most preferably to less than about 5%) such that the errors during transients will be larger than the deadbands in order not to compromise the transient responses.

In another preferred practice of the present invention that may be employed where speed controllers are used to control the speed of the main feedwater pumps, the pressure of the feedwater flowing to the steam generator and the pressure and the amount of steam flowing from the steam generator are monitored. A feedwater pressure signal based upon the pressure of the feedwater and a steam pressure signal based upon the pressure of the steam are generated. An error signal based upon the difference between the feedwater pressure signal and the steam pressure signal is generated. The error signal is filtered by a deadband network to generate a control signal that changes only when the dead band is exceeded. The control signal is then sent to a feedwater proportional-integral controller for generating a demand signal. The demand signal is then sent to a speed controller controlling a feedwater pump.

BRIEF DESCRIPTION OF THE DRAWINGS

The invention as set forth in the claims will become more apparent from the following detailed description of certain preferred practices thereof illustrated, by way of example only, in the accompanying drawings, wherein:

DESCRIPTION OF THE PREFERRED PRACTICES

Figure 1:
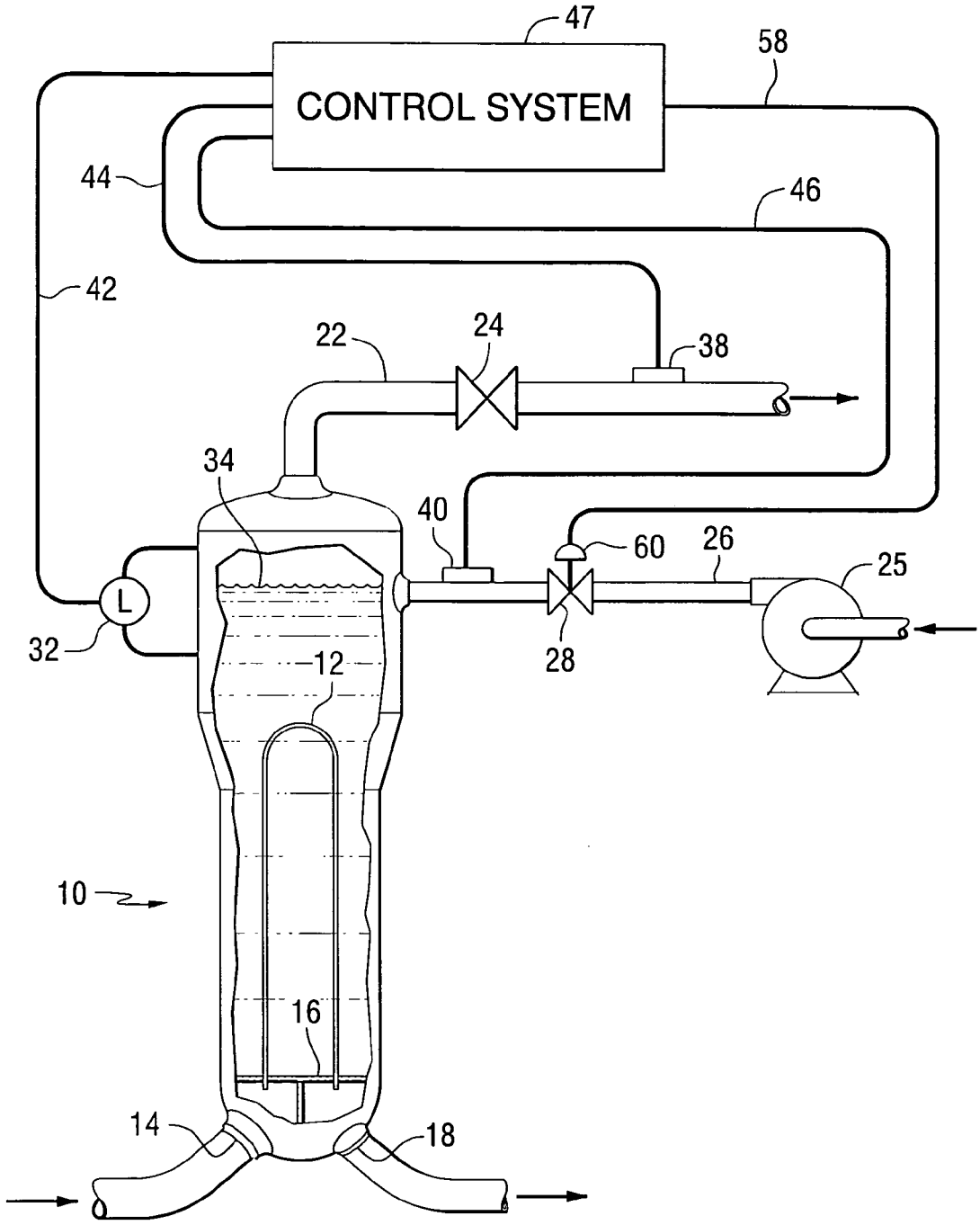
FIG. 1 is schematic representation of a commercial PWR steam generator.

Referring now to the drawings in detail and in particular to FIG. 1, there is shown a steam generator 10 in a commercial pressurized water reactor (PWR) with a control system that may be employed in a preferred practice of the present invention when the PWR is generating power. The steam generator 10 has thousands of small diameter tubes in a tube bundle represented by tube 12, which may be U tubes extending above a tubesheet 16 as shown or straight tubes extending between two tubesheets. The primary water from a reactor pressure vessel (not shown) flows into the primary side of the steam generator 10 through an inlet nozzle 14 in a lower hemispherical head, through the tubes 12 in the tubesheet, out of the steam generator 10 through an outlet nozzle 18 and back to the reactor pressure vessel. On the secondary side of the steam generator 10, steam is generated and flows out through steam line 22 and main steam valve 24 to turbines (not shown) for generating electrical power. The low pressure steam exhausted from the turbines is condensed and then pumped back to the steam generator 10 by a main feedwater pump 25 through a feedwater water line 26. The flow of feedwater through line 26 may be controlled by a main feedwater valve 28 as shown.

Alternatively, one or more main feedwater pumps 25 arranged in parallel may be controlled by a speed controller (not shown).

In the practice of the present invention, selected process variables around the secondary side of the steam generator 10 are monitored. Thus, the PWR facility shown in FIG. 1 employs sensors 32, 38 and 40 to monitor the water level 34 in the steam generator 10, the steam flow in main steam line 22 and the feedwater flow in feedwater line 26, respectively, in a preferred practice. Such sensors may be electrical resistance level indicators, venturi meters, ultrasonic flow meters and the like. In other practices, other sensors (not shown) may be employed to monitor such other process variables as the feedwater pressure, steam pressure and turbine impulse stage pressure. Transducers (not shown) may be employed to send process signals based upon these sensed process variables on lines 42, 44 and 46, respectively, to a control system 47 for controlling the feedwater flow to the secondary side of the steam generator. Importantly, the feedwater flow must maintain the water level 34 in the steam generator 10 above the tube bundle 12 to protect the tubes. During normal operation, i.e., over about 20% full power, the control system 47 controls the feedwater flow in response to the water level 34 and the "mismatch" between the feedwater flow and the steam flow. See, for example, the above-mentioned U.S. Pat. Nos. 6,021,169; 5,455,763; 5,192,493; 4,777,009 and 4,728,481, which describe known control systems.

Figure 2:
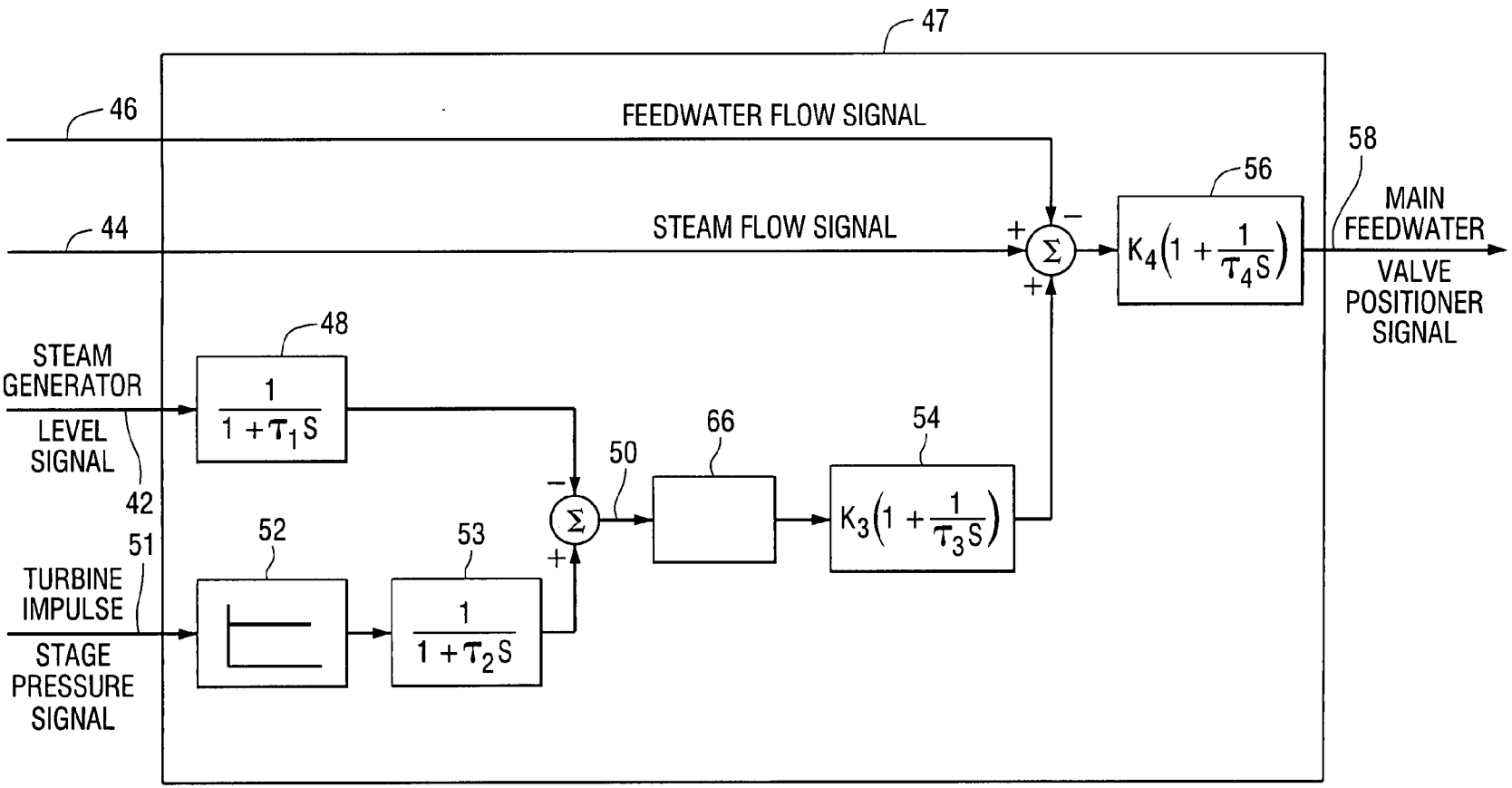
FIG. 2 is a functional block diagram of a first steam generator control system for practicing the present invention during power operations when the power level is at least about 20% of full power.

FIG. 2 shows the principal functional elements of a control system 47 for controlling the feedwater flow in line 26 during normal power generating operation. The control system 47 is an improvement of a known control system. In the known control system, a water level signal on line 42 is filtered by a filtering network 48 to dampen the natural oscillations.

The signal is then compared with a set point to generate a water level error signal on line 50. As shown, the set point is a programmed level on line 51 derived from a signal from a function card 52 based upon the turbine impulse stage pressure and filtered by a filtering network 53. The error signal on line 50 is sent through a proportional-integral controller 54 that reduces, and preferably eliminates, steady state level errors. The control signal from the controller 54 is added to the mismatch between the steam flow signal on line 44 and the feedwater flow signal on line 46. The compensated control signal is then sent to a main feedwater proportional-integral controller 56. The main feedwater proportional-integral controller 56 is designed to reduce, and preferably eliminate, steady state errors in the feed water flow. The demand signal from the main feedwater proportional-integral controller 56 is then sent on line 58 to a valve positioner 60 on the main feedwater control valve 28.

It has been found that the water level error signal generated by the known control system may be filtered by a deadband network 66 without significantly affecting the transient response of the control system. A function generator card may be employed to implement the deadband, such as a Westinghouse NCH card for an analog control system or a digital algorithm for a digital control system. Preferably the deadband is less than about 5% of the full range and most preferably about 1% of the full range. In a preferred practice, the deadband filter is field adjustable such that it is set above the steady state fluctuations.

The preferred practice of controlling feedwater flow to the secondary side of a steam generator 10 in a PWR with the improved control system 47 of FIG. 2 includes the steps of:

- monitoring selected process variables around the secondary side of the steam generator 10 including the water level 34, the feedwater flow in line 26 and the steam flow in line 22;
- generating process signals based upon the monitored process variables including a water level signal, a steam flow signal and a feedwater flow signal;
- generating an error signal based upon at least one of the generated process signals, which may be the water level signal as is shown by FIG. 2;
- filtering the error signal to generate a control signal with a deadband;
- sending the control signal with a deadband to a proportional-integral controller 56 to generate a demand signal; and
- sending the demand signal to an operator for controlling the feedwater flow, such as a valve positioner 60 on the main feedwater control valve 28.

Advantageously, the use of a filter with a proportional-integral controller will effectively control the feedwater flow with less wear of the control system hardware. This may be seen from a comparison of the data of FIG. 3 with the data of FIG. 4.

Figure 3:
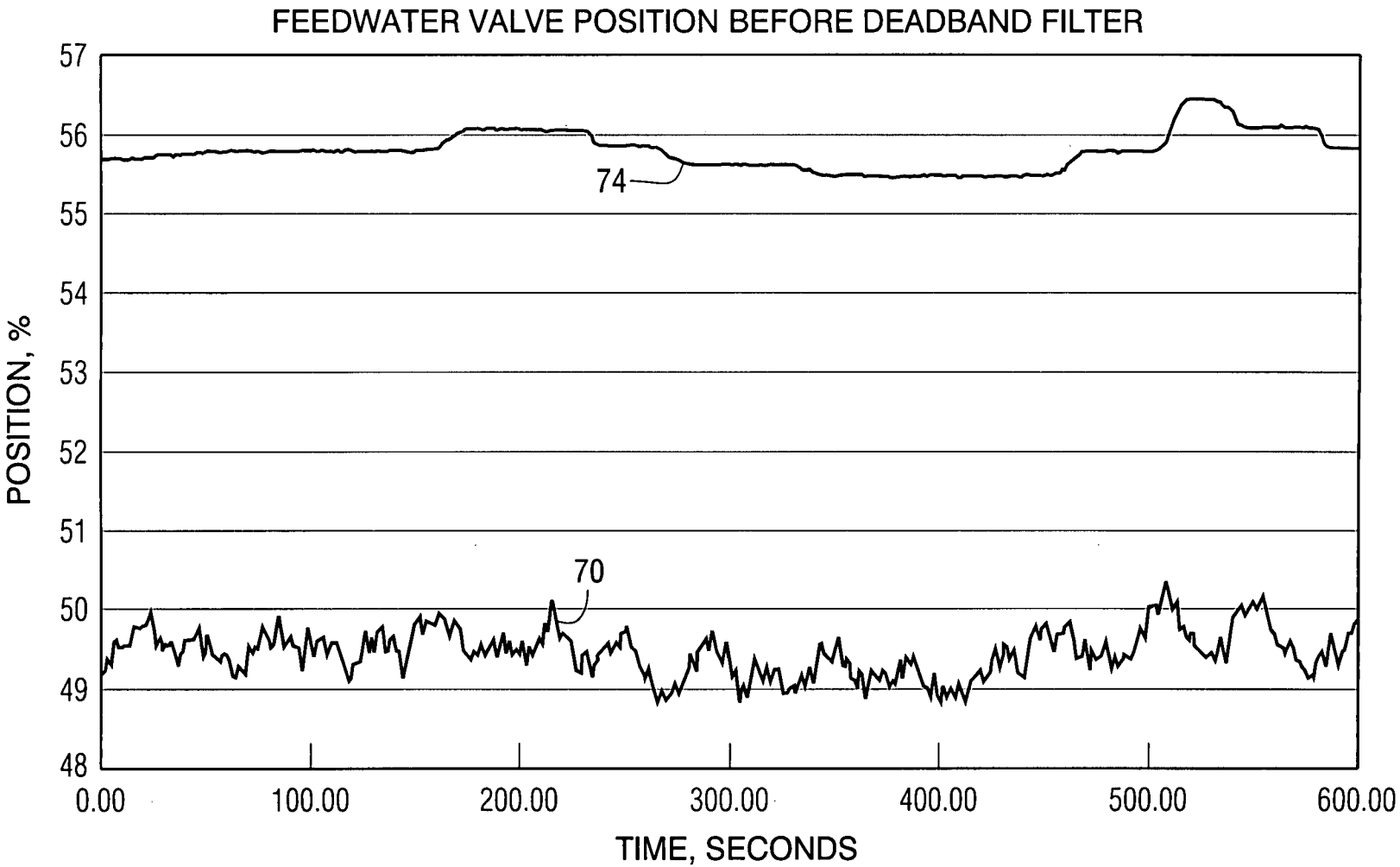
FIG. 3 is a graphical presentation of field data taken on a commercial PWR steam generator controlled by a prior art control system without a dead band filter.
Figure 4:
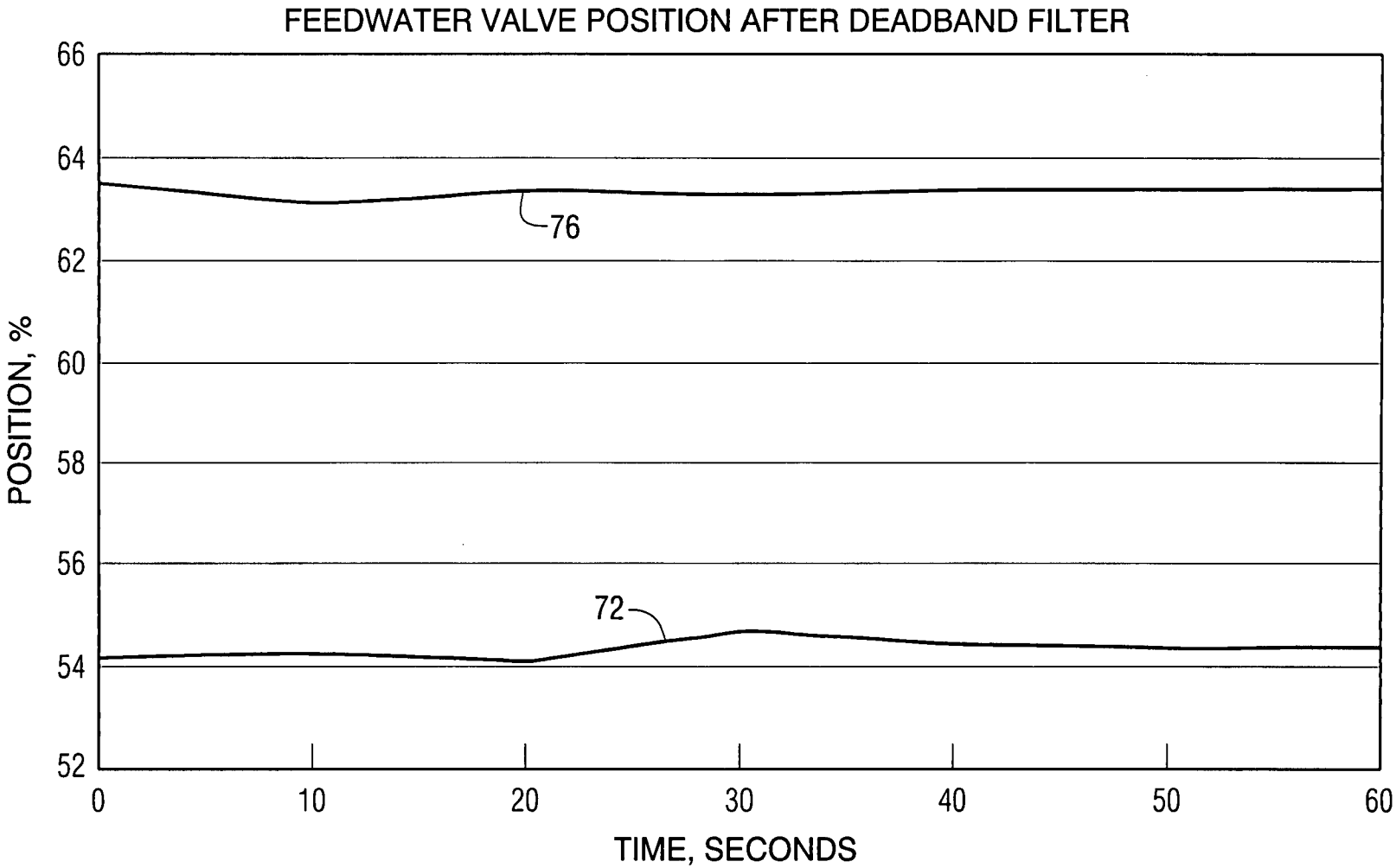
FIG. 4 is a graphical presentation of field data taken on the same commercial PWR after installation of a deadband filter in the control system.

FIGS. 3 and 4 show data relating to a commercial PWR during normal power generating operations. The data of FIG. 3 was taken before a deadband network 66 was incorporated in the control system 47. The data was taken every second for 600 seconds. The data of FIG. 4 was taken after a deadband network 66 was incorporated into the control system 47. The data was taken every five minutes for sixty minutes. Curve 70 of FIG. 3 and curve 72 of FIG. 4 indicates the demand signal to the feedwater proportional-integral controller 56. Curve 74 of FIG. 3 and curve 76 indicates the position of the feedwater valve positioner 60. A comparison of curves 74 and 76 shows that the use of a deadband network 66 resulted in a more stable valve positioner 60. A plant control engineer involved in the test summarized by FIG. 4 reported that the control system behaved properly without any discontinuities.

The main feedwater pumps 25 of PWRs may have turbine drives operated by a speed controller. In a known pump speed control system, a programmed pressure difference between the discharge of the main feedwater pump 25 and the steam header 22 is derived as a function of the steam flow. A process signal based upon the steam flow is passed through a lag unit to slow the effect of large steam flow perturbations and is summed with a bias signal that allows feedwater flow against static head losses at no-load conditions. An error signal is generated by a comparison between the programmed pressure difference with the actual pressure difference signal. The error signal is sent to a proportional-integral controller that provides a demand signal.

Figure 5:
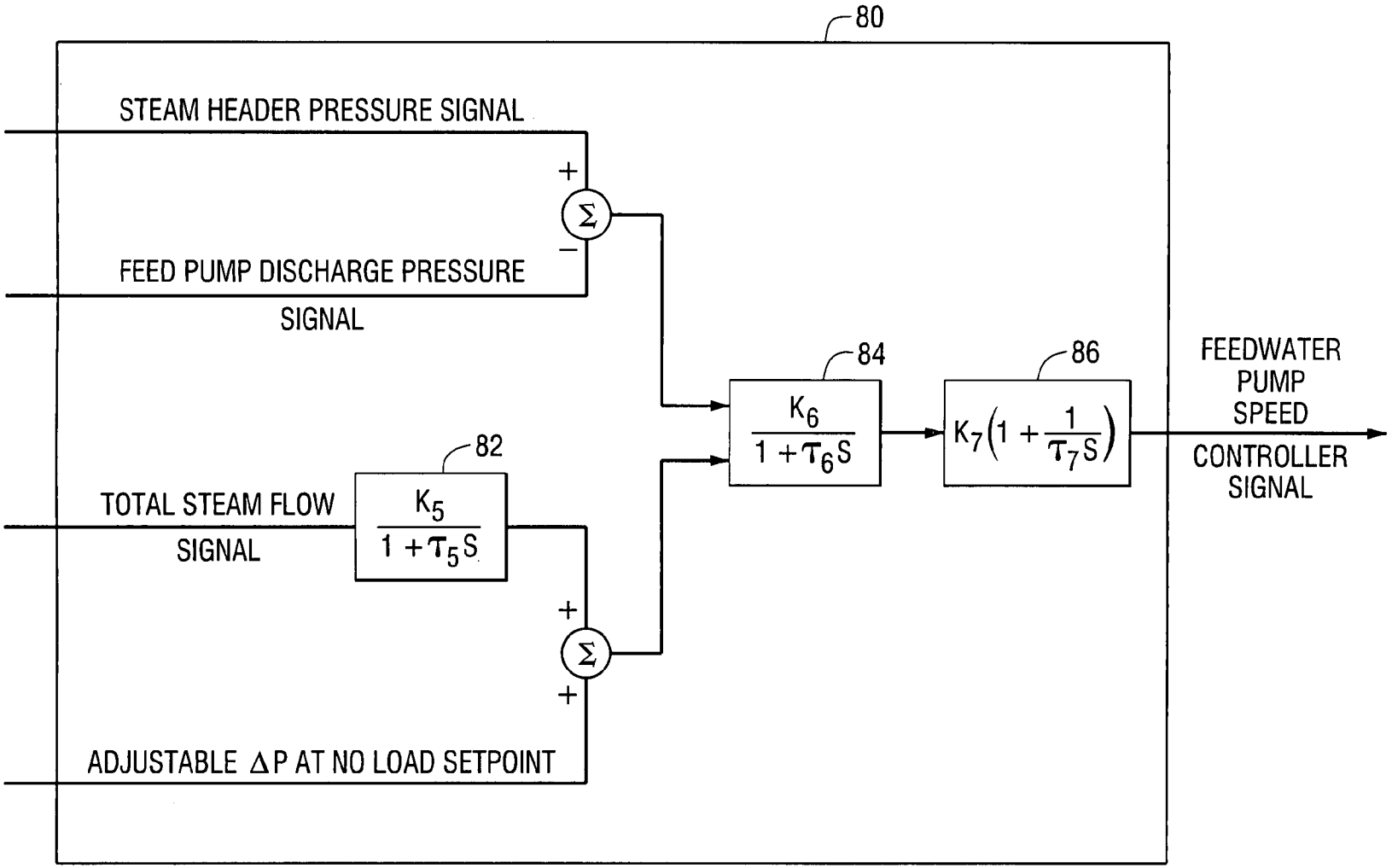
FIG. 5 is a functional block diagram of a second steam generator control system for practicing the present invention when speed controllers are employed to control the main feedwater pumps.

The present invention may be advantageously employed in PWRs having feedwater pump turbine drives operated by speed controllers by sending an error signal with a deadband to a proportional-integral controller for sending a demand signal to the speed controller for controlling the feedwater flow. FIG. 5 shows the principal functional elements of a control system 80 for controlling the speed of a feedwater pump turbine drive in accordance with the method of the present invention. The control system 80 may determine the actual pressure difference between the main feedwater pump discharge (which may be determined in feedwater line 26) and the steam header 22. The control system 80 may also generate a process signal based upon the steam flow and pass the signal through a lag unit 82 and sum the process signal with a bias signal that allows feedwater flow against static head losses at no-load conditions. The signals indicating the actual pressure difference and the biased programmed pressure difference may then be filtered by a deadband network 84 and a filtered signal with a deadband sent to a proportional-integral controller 86 (which may include a derivative element) for generating a demand signal.

Thus, the preferred practice of controlling feedwater flow to the secondary side of a steam generator 10 in a PWR with the improved control system 80 of FIG. 5 includes the steps of:

monitoring selected process variables around the secondary side of the steam generator 10 including the pressure of the steam in line 22, the pressure of the feedwater in line 26 and the amount of steam flowing in line 22;

generating process signals based upon the monitored process variables;

generating an error signal based upon at least one of the generated process signals, which may be pressure difference between the feedwater pressure and the steam pressure;

filtering the error signal with a filter network 84 to generate a control signal with a deadband;

sending the control signal with a deadband to a proportional-integral controller 86 to generate a demand signal; and sending the demand signal to a speed controller controlling the turbine speed.

What is claimed is:

1. A method of controlling feedwater flow to the secondary side of a steam generator in a pressurized water nuclear reactor, comprising the steps of:

monitoring process variables around the secondary side of the steam generator;

generating process signals based upon the monitored process variables;

generating an error signal based upon at least one of the process signals;

filtering the error signal to generate a control signal with a deadband;

sending the control signal with a deadband to a proportional-integral controller to generate a demand signal; and sending the demand signal to an operator for controlling the feedwater flow.

2. The method of claim 1, wherein the step of monitoring process variables comprises monitoring feedwater flow to the secondary side of the steam generator, monitoring steam flow from the secondary side of the steam generator and monitoring water level in the steam generator.

3. The method of claim 2, wherein the step of generating process signals comprises generating a water level signal and the step of generating an error signal comprises generating an error signal based upon the water level signal.

4. The method of claim 3, wherein the step of sending the demand signal to an operator comprises sending the demand signal to a valve operator controlling a main feedwater valve.

5. The method of claim 1, wherein the step of monitoring process variables comprises monitoring pressure of the feedwater flowing to the steam generator, monitoring pressure of the steam flowing from the steam generator and monitoring the amount of steam flowing from the steam generator.

6. The method of claim 5, wherein the step of generating process signals comprises generating a feedwater pressure signal based upon the pressure of the feedwater downstream of a main feedwater pump and generating a steam pressure signal based upon the pressure of the steam in a header from the steam generator and the step of generating an error signal comprises generating an error signal based upon difference between the feedwater pressure signal and the steam pressure signal.

7. The method of claim 6, wherein the step of sending a demand signal comprises sending a demand signal to a speed controller controlling the main feedwater pump.

8. The method of claim 1, wherein the deadband is field adjustable.

9. The method of claim 1, wherein the deadband is less than 5%.

10. The method of claim 1, wherein the deadband is about 1%.

* * * * *